US006296230B1

(12) United States Patent
Roth

(10) Patent No.: US 6,296,230 B1
(45) Date of Patent: Oct. 2, 2001

(54) DOOR LIFTING DEVICE

(76) Inventor: W. Richard Roth, 161 Goucher Dr., Pittsburgh, PA (US) 15236

( * ) Notice: Subject to any disclaimer, the term of this patent is extended or adjusted under 35 U.S.C. 154(b) by 0 days.

(21) Appl. No.: 09/540,520

(22) Filed: Mar. 31, 2000

(51) Int. Cl.[7] ..... B66F 3/00
(52) U.S. Cl. ..... 254/131
(58) Field of Search ..... 254/25, 131, 28, 254/8 B, 120

(56) References Cited

U.S. PATENT DOCUMENTS

| | | | | |
|---|---|---|---|---|
| 743,183 | * | 11/1903 | Miller | 254/25 |
| 2,569,242 | * | 9/1951 | Kors | 254/131 |
| 2,692,753 | * | 10/1954 | Masterson et al. | 254/131 |
| 2,989,286 | * | 6/1961 | Gillespie | 254/131 |
| 3,155,255 | * | 11/1964 | Daniel | 254/131 |
| 4,205,823 | * | 6/1980 | Goldy | 254/28 |
| 4,553,737 | * | 11/1985 | Yi | 254/28 |
| 5,749,113 | * | 5/1998 | Witter | 254/131 |
| 5,814,842 | * | 9/1998 | Muldoon et al. | 254/131 |
| 5,884,900 | * | 3/1999 | Gobeil et al. | 254/25 |
| 6,079,696 | * | 6/2000 | Bette | 254/131 |

* cited by examiner

*Primary Examiner*—Robert C. Watson

(57) ABSTRACT

A door liftinng device for lifting a door into an installation position. The door lifting device includes a lever member being longitudinal, curved from a first end to near a second end which is curved away from the top side of the lever member; and also includes a fulcrum member being semi-circular shaped and being securely attached to the bottom side of the lever member near the first end thereof; and further includes a door abutment member securely attached to the top side of the lever member and being disposed closer to the first end than is the fulcrum member so that a door can be mounted between the door abutment member and the first end of the lever member.

9 Claims, 2 Drawing Sheets

10
18
14
17
19
13
11
16
12

10
17
11
13
12
16

DOOR LIFTING DEVICE

BACKGROUND OF THE INVENTION

1. Field of the Invention

The present invention relates to a door lifter and more particularly pertainis to a new door lifting device for lifting a door into an installation position.

2. Description of the Prior Art

The use of a door lifter is known in the prior art. More specifically, a door lifter heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,871,054; 4,010,931; 1,681,834; 3,876,096; 5,814,842; and U.S. Pat. No. Des. 268,477.

While these devices fulfill their respective, particular objectives and requirements, the aforementioned patents do not disclose a new door lifting device. The inventive device includes a lever member being longitudinally curved from a first end to near a second end which is curved away from the top side of the lever member; and also includes a fulcrum member being semi-circular shaped and being securely attached to the bottom side of the lever member near the first end thereof, and further includes a door abutment member securely attached to the top side of the lever member and being disposed closer to the first end than is the fulcrum member so that a door can be mounted between the door abutment member and the first end of the lever member.

In these respects, the door lifting device according to the present invention substantially departs from the conventional concepts and designs of the prior art, and in so doing provides an apparatus primarily developed for the purpose of lifting a door into an installation position.

SUMMARY OF THE INVENTION

In view of the foregoing disadvantages inherent in the known types of door lifter now present in the prior art, the present invention provides a new door lifting device construction wherein the same can be utilized for lifting a door into an installation position.

The general purpose of the present invention, which will be described subsequently in greater detail, is to provide a new door lifting device which has many of the advantages of the door lifter mentioned heretofore and many novel features that result in a new door lifting device which is not anticipated, rendered obvious, suggested, or even implied by any of the prior art door lifter, either alone or in any combination thereof.

To attain this, the present invention generally comprises a lever member being longitudinally curved from a first end to near a second end which is curved away from the top side of the lever member; and also includes a fulcrum member being semi-circular shaped and being securely attached to the bottom side of the lever member near the first end thereof; and further includes a door abutment member securely attached to the top side of the lever member and being disposed closer to the first end than is the fulcrum member so that a door can be mounted between the door abutment member and the first end of the lever member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including, such equivalent constructions insofar as they do not depart from the spirit and scope of the present invention.

Further the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door lifting device which has many of the advantages of the door lifter mentioned heretofore and many novel features that result in a new door lifting device which is not anticipated, rendered obvious, suggested, or even implied by any of the prior art door lifter, either alone or in any combination thereof.

It is another object of the present invention to provide a new door lifting device which may be easily and efficiently manufactured and marketed.

It is a further object of the present invention to provide a new door lifting device which is of a durable and reliable construction.

An even further object of the present invention is to provide a new door lifting device which is susceptible of a low cost of manufacture with regard to both materials and labor, and which accordingly is then susceptible of low prices of sale to the consuming public, thereby making such door lifting device economically available to the buying public.

Still yet another object of the present invention is to provide a new door lifting device which provides in the apparatuses and methods of the prior art some of the advantages thereof, while simultaneously overcoming some of the disadvantages normally associated therewith.

Still another object of the present invention is to provide a new door lifting device for lifting a door into an installation position.

Yet another object of the present invention is to provide a new door lifting device which includes a lever member being longitudinally curved from a first end to near a second end which is curved away from the top side of the lever member; and also includes a fulcrum member being semi-circular shaped and being securely attached to the bottom side of the lever member near the first end thereof; and further includes a door abutment member securely attached to the top side of the lever member and being disposed closer to the first end than is the fulcrum member so that a door can be mounted between the door abutment member and the first end of the lever member.

Still yet another object of the present invention is to provide a new door lifting device that is very easy and convenient to use and manipulate to lift a door.

Even still another object of the present invention is to provide a new door lifting device that is lightweight and non-cumbersome.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
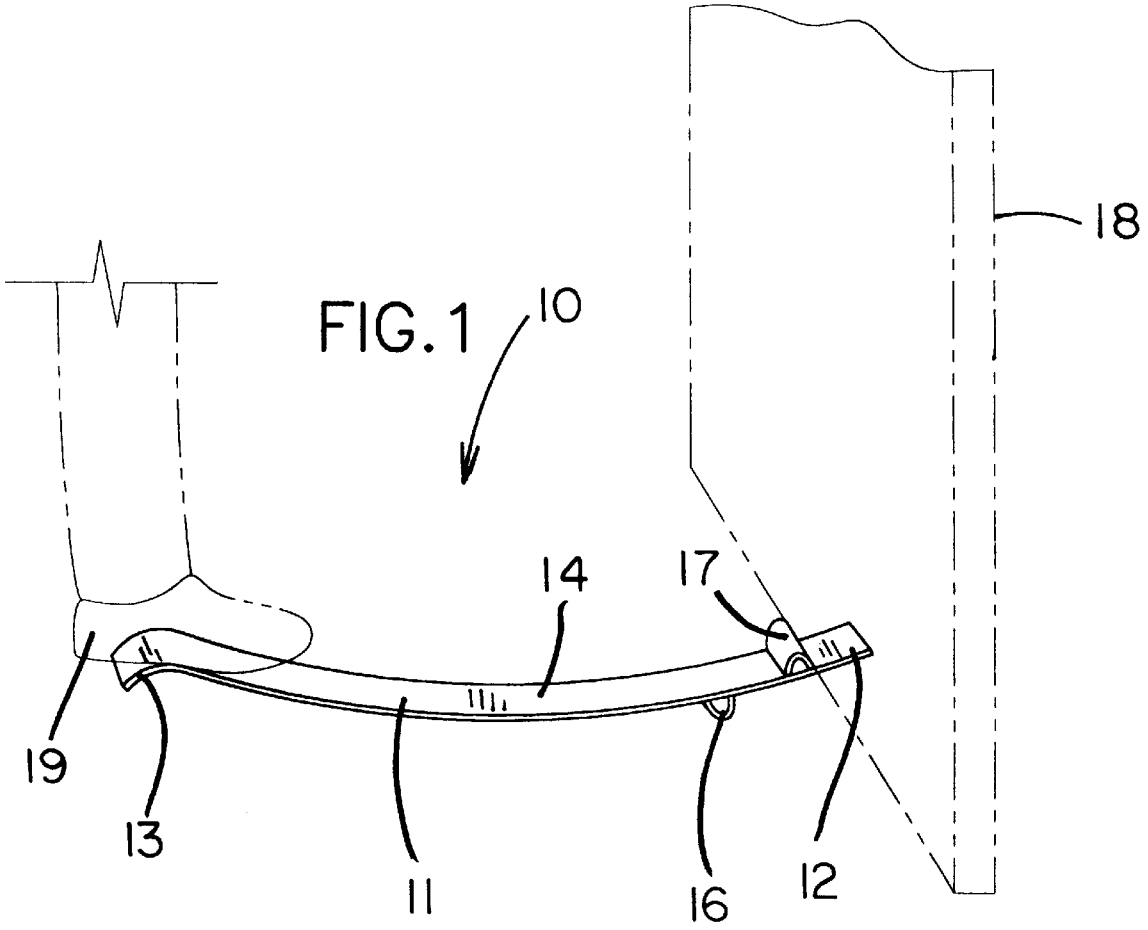
FIG. 1 is a perspective view of a new door lifting device according to the present invention and shown in use.
Figure 2:
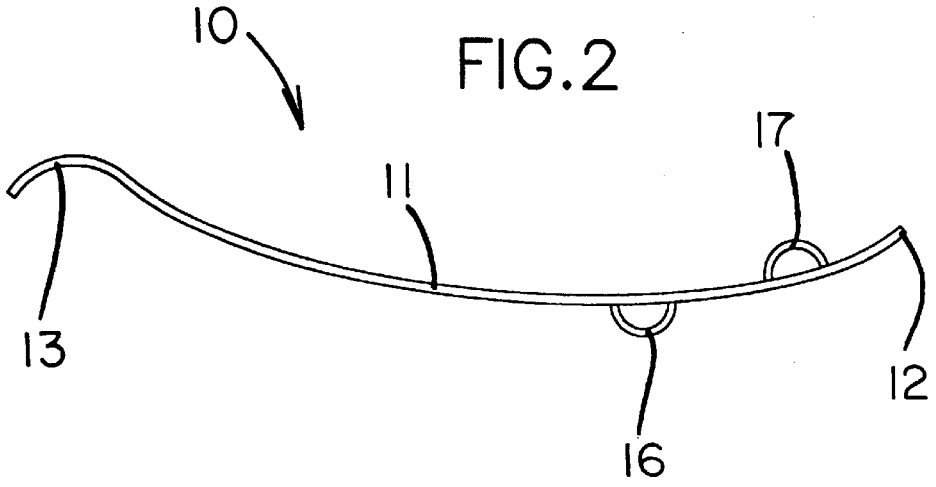
FIG. 2 is a side elevational view of the present invention.
Figure 3:
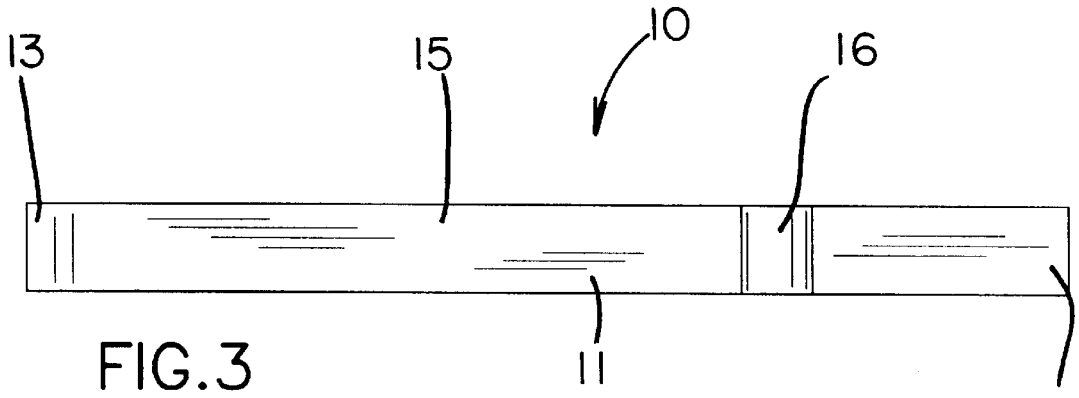
FIG. 3 is a bottom plan view of the present invention.
Figure 4:
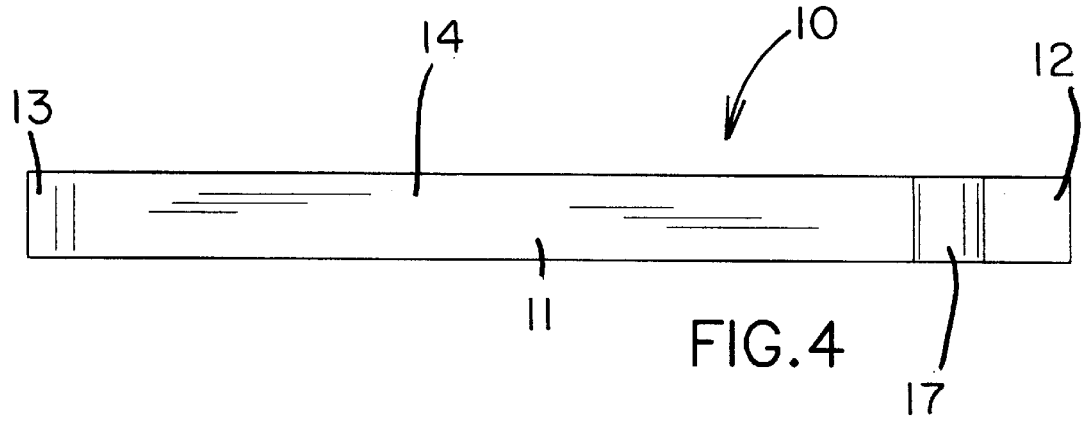
FIG. 4 is a top plan view of the present invention.
Figure 5:
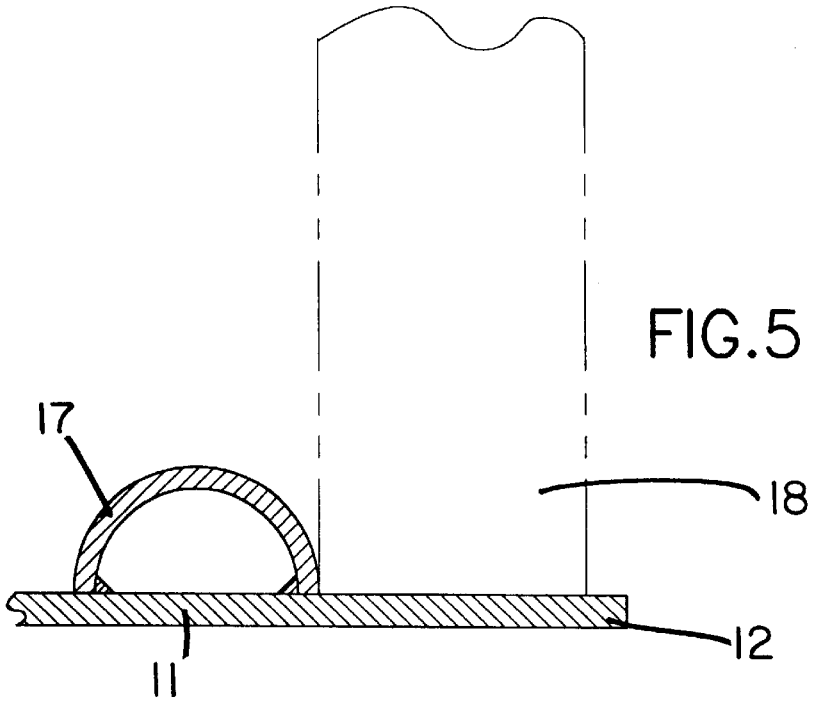
FIG. 5 is a detailed side elevational view of the door abutment member and first end of the lever member of the present invention.

With reference now to the drawings and in particular to FIGS. 1 through 5 thereof a new door lifting device embodying the principles and concepts of the present invention and generally designated by the reference numeral 10 will be described.

As best illustrated in FIGS. 1 through 5 the door lilting device 10 generally comprises a lever member 11 having a first end 12, a second end 13, a top side 14 and a bottom side 15, and being longitudinally curved from the first end 12 to near the second end 13. The lever member 11 is downwardly curved from the first 12 and second 13 ends thereof with the second end 13 being curved away from the top side 14 of the lever member 11 to limit the height the first end 12 of the lever member 11 can be raised to lift a door 18. The lever member 11 has a length of approximately 18 to 20 inches and a width of approximately 2 inches.

A fulcrum member 16 is securely and conventionally attached and welded to the bottom side 15 and spaced from the first end 12 of the lever member 11 and is adapted to support the lever member 11. The fulcrum member 16 is semi-circular shaped and is adapted to rest upon a ground surface.

A door abutment member 17 is securely and conventionally attached and welded to the top side 14 near the first end 12 of the lever member 11. The door abutment member 17 is spaced closer to the first end 12 than is the fulcrum member 16 with the space between the door abutment member 17 and the first end 12 being adapted to support a bottom of a door 18 thereupon.

In use, the user slides the first end 12 of the lever member 11 beneath the bottom of a door 18 and with one's foot 19 the user steps down upon the second end 13 which causes the first end 12 to rise and lift the door 18 and place the door 18 as desired by the user.

As to a further discussion of the manner of usage and operation of the present inventions the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door lifting device comprising:

a lever member having a first end, a second end, a top side and a bottom side, and being longitudinally curved from said first end to near said second end;

a fulcrum member securely attached to said bottom side and spaced from said first end of said lever member and being adapted to support said lever member;

a door abutment member securely attached to said top side near said first end of said lever member;

wherein a distance between said fulcrum member and said door abutment member is substantially equal to a distance between said door abutment member and said first end of said lever member.

2. A door lifting device as described in claim 1, wherein said lever member is downwardly curved from said first and second ends thereof.

3. A door lifting device as described in claim 1, wherein said second end is curved away from said top side of said lever member to limit the height said first end of said lever member can be raised.

4. A door lifting device as described in claim 1, wherein said fulcrum member is semi-circular shaped and is adapted to rest upon a ground surface.

5. A door lifting device as described in claim 1, wherein said door abutment member is spaced closer to said first end than is said fulcrum member, said space between said door abutment member and said first end is adapted to support a bottom of a door thereupon.

6. A door lifting device as described in claim 1, wherein said lever member has a length of approximately 18 to 20 inches and a width of approximately 2 inches.

7. A door lifting device comprising:

a lever member having a first end, a second end, a top side and a bottom side, and being, longitudinally curved from said first end to near said second end, said lever member being downwardly curved from said first and second ends thereof, said second end being curved away from said top side of said lever member to limit the height said first end of said lever member can be raised, said lever member having a length of approximately 18 to 20 inches and a width of approximately 2 inches;

a fulcrum member securely attached to said bottom side and spaced from said first end of said lever member and being adapted to support said lever member, said fulcrum member being semi-circular shaped and being adapted to rest upon a ground surface;

a door abutment member securely attached to said top side near said first end of said lever member, said door abutment member being spaced closer to said first end than is said fulcrum member, said space between said door abutment member and said first end being adapted to support a bottom of a door thereupon; and wherein a distance between said fulcrum member and said door abutment member is substantially equal to a distance between said door abutment member and said first end of said lever member.

8. A door lifting device as described in claim 1, wherein said door abutment member is semi-circular shaped and is adapted to rest upon a ground surface.

9. A door lifting device comprising:

a lever member having a first end, a second end, a top side and a bottom side, and being longitudinally curved from said first end to near said second end;

a fulcrum member securely attached to said bottom side and spaced from said first end of said lever member and being adapted to support said lever member;

a door abutment member securely attached to said top side near said first end of said lever member;

wherein said door abutment member is located approximately at a midpoint between said fulcrum member and said first end of said lever member.

* * * * *